US012203488B2

(12) United States Patent
Riski et al.

(10) Patent No.: US 12,203,488 B2
(45) **Date of Patent: *Jan. 21, 2025**

(54) FAN SHROUD FOR A VEHICLE HEAT-EXCHANGE MODULE

(71) Applicant: VALEO SYSTEMES THERMIQUES, La Verriere (FR)

(72) Inventors: Roy Riski, La Verriere (FR); Davide Molinari, La Verriere (FR); Catalino Loredo Guzman, La Verriere (FR)

(73) Assignee: Valeo Systemes Thermiques, La Verriere (FR)

( * ) Notice: Subject to any disclaimer, the term of this patent is extended or adjusted under 35 U.S.C. 154(b) by 226 days.

This patent is subject to a terminal disclaimer.

(21) Appl. No.: 17/900,952

(22) Filed: Sep. 1, 2022

(65) Prior Publication Data

US 2024/0077088 A1 Mar. 7, 2024

(51) Int. Cl.
*F24H 3/06* (2022.01)
*F04D 29/70* (2006.01)
*F28F 13/12* (2006.01)

(52) U.S. Cl.
CPC ..... *F04D 29/703* (2013.01)

(58) Field of Classification Search
CPC ..... F04D 29/703
USPC ..... 165/122
See application file for complete search history.

(56) References Cited

U.S. PATENT DOCUMENTS 11,781,467 B1 * 10/2023 Riski ..... F01P 5/06 123/41.49
2001/0018022 A1 8/2001 Nakamura
2005/0079051 A1 4/2005 Soofer et al.
2006/0147302 A1 7/2006 Iwasaki et al.
2008/0292458 A1 11/2008 Tani et al.
2009/0133663 A1 5/2009 Maeda et al.
2012/0321474 A1 12/2012 Stevens et al.
2013/0306006 A1 11/2013 Mott et al.
2018/0135649 A1 5/2018 Ishida et al.
(Continued)

FOREIGN PATENT DOCUMENTS

CN 104948494 A 9/2015
DE 102020210612 A1 2/2022
JP 2000240456 A 9/2000
(Continued)

OTHER PUBLICATIONS

European Patent Office, International Search Report and Written Opinion of corresponding International Application No. PCT/EP2023/072650, dated Nov. 13, 2023.

*Primary Examiner* — Davis D Hwu
(74) *Attorney, Agent, or Firm* — Valeo Systemes Thermiques

(57) ABSTRACT

A fan shroud for a vehicle heat-exchange module, having a wall configured to at least partially block the airflow through the fan shroud between a front and a back thereof, with a first opening for enabling airflow through the fan shroud between a front and a back thereof. The fan shroud further includes fasteners adapted to mount the fan shroud in an inclined position with respect to the ground, and a first drainage opening for a fluid, arranged at a bottom of the fan shroud and a first slope with a lowest point being at the level of the first drainage opening when the fan shroud is in the inclined position.

16 Claims, 7 Drawing Sheets

(56) References Cited

U.S. PATENT DOCUMENTS

2019/0234429 A1 8/2019 Gu et al.

FOREIGN PATENT DOCUMENTS

| | | | |
|---|---|---|---|
| JP | 2002106500 | A | 4/2002 |
| JP | 2009109103 | A | 5/2009 |
| JP | 2009250226 | A | 10/2009 |
| JP | 2012082733 | A | 4/2012 |
| JP | 2016121574 | A | 7/2016 |
| KR | 101355612 | B1 | 1/2014 |
| KR | 20140011484 | A | 1/2014 |
| KR | 20140112832 | A | 9/2014 |
| KR | 20150071882 | A | 6/2015 |
| KR | 20150072733 | A | 6/2015 |
| KR | 101673784 | B1 | 11/2016 |
| KR | 20170037271 | A | 4/2017 |
| KR | 20190047281 | A | 5/2019 |
| WO | 2005028875 | A1 | 3/2005 |
| WO | 2019186687 | A1 | 10/2019 |
| WO | 2022169204 | A1 | 8/2022 |

* cited by examiner

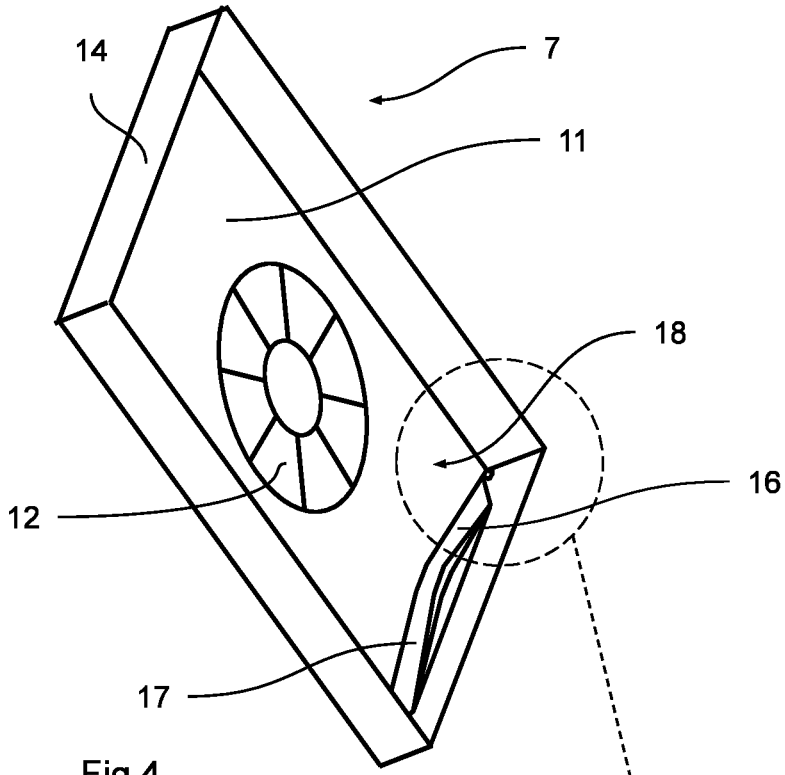
Fig.4
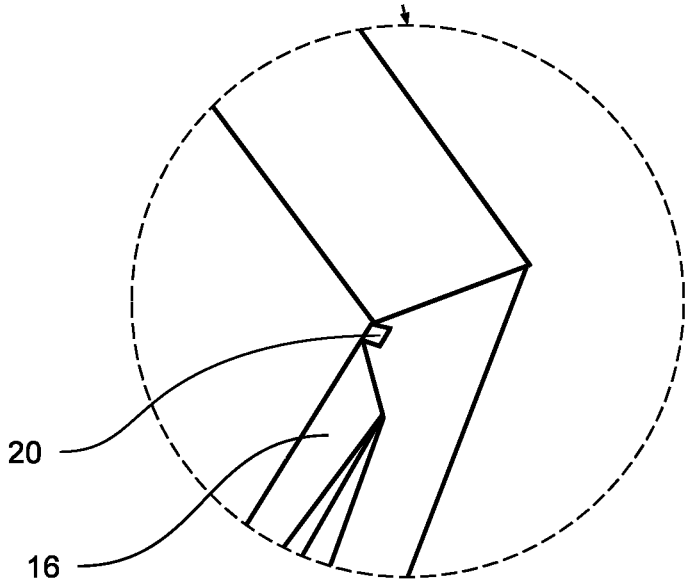

FAN SHROUD FOR A VEHICLE HEAT-EXCHANGE MODULE

TECHNICAL FIELD

The invention relates to the field of heat-exchange modules for motor vehicles, in particular to heat-exchange modules with fans mounted on fan shrouds.

BACKGROUND OF THE INVENTION

Heat-exchange modules can be placed in the front section of a motor vehicle, for example at the level of a grille of such a vehicle, and they generally comprise an air inlet duct, a set of heat exchangers, a conduit for these exchangers, and a motorized propeller whose role is to convey the air captured directly from the outside of the vehicle by a front grille to the heat exchangers of the heat-exchange module. The heat exchangers are stacked to be housed and fixed in an interior volume delimited by the conduit. In other words, the conduit surrounds the exchangers that it supports. In addition, the conduit can guide the air entering the heat-exchange module through the heat exchangers by guaranteeing that a maximum level of the airflow is conveyed.

When the airflow is insufficient, for example when the speed of the vehicle is not high enough, the motorized propeller, otherwise known as a fan, is utilized to force the airflow within the conduit.

The air entering the conduit may contain water, moisture or other foreign matter. Presence of such matter can be detrimental to the operation and longevity of the heat-exchange module and its components, in particular when the vehicle is subject to varying temperature including freezing conditions.

BRIEF SUMMARY OF THE INVENTION

The object of the invention is, among others, a fan shroud for a vehicle heat-exchange module, comprising: a wall configured to at least partially block the airflow through the fan shroud between a front and a back thereof, with a first opening for enabling airflow through the fan shroud between a front and a back thereof, fasteners adapted to mount the fan shroud in an inclined position with respect to the ground, a first drainage opening for a fluid, arranged at a bottom of the fan shroud and a first slope with a lowest point being at the level of the first drainage opening when the fan shroud is in the inclined position.

In one embodiment, a first wall part of the wall terminates at the first slope.

In one embodiment, the wall includes a second opening for enabling airflow through the fan shroud between the front and the back thereof.

In one embodiment, the fan shroud includes a second slope sloping in a direction opposite than the sloping direction of the first slope.

In one embodiment, the fan shroud includes a second slope sloping in a direction opposite than the sloping direction of the first slope, wherein the wall includes a second opening for enabling airflow through the fan shroud between the front and the back thereof, the first opening being arranged over the first slope and the second opening being arranged above the second slope.

In one embodiment, the fan shroud includes a second slope sloping in a direction opposite than the sloping direction of the first slope, wherein the wall includes a second opening for enabling airflow through the fan shroud between the front and the back thereof, both the first opening and the second opening being arranged over the first slope.

In one embodiment, the lowest point of the second slope terminates in a second drainage opening.

In one embodiment, a second wall part of the wall terminates at the second slope.

In one embodiment, the first slope and the second slope have a common highest point.

In one embodiment, the first slope and the second slope have a common lowest point.

In one embodiment, the first slope and the second slope are arranged symmetrically with respect to the central portion of the fan shroud.

In one embodiment, the fan shroud includes a first gutter arranged at the bottom and connected fluidically with the first drainage opening to evacuate the fluid remotely with respect to the first drainage opening.

In one embodiment, the fan shroud has a rectangular outline.

In one embodiment, the first drainage opening is located at a bottom corner of the fan shroud.

In one embodiment, the fan shroud has a rectangular outline, the first drainage opening being located at a bottom corner of the fan shroud, and the lowest point of the second slope terminating in a second drainage opening, wherein the second drainage opening is located at the opposite bottom corner of the fan shroud.

Another object of the invention is a heat-exchange module including at least one heat exchanger, a fan shroud for a vehicle heat-exchange module, comprising: a wall configured to at least partially block the airflow through the fan shroud between a front and a back thereof, with a first opening for enabling airflow through the fan shroud between a front and a back thereof, fasteners adapted to mount the fan shroud in an inclined position with respect to the ground, a first drainage opening for a fluid, arranged at a bottom of the fan shroud and a first slope with a lowest point being at the level of the first drainage opening when the fan shroud is in the inclined position; a fan attached to the fan shroud, a conduit encapsulating the at least one heat exchanger and including an air inlet, so that the air entering the air inlet is guided through the at least one heat exchanger and the at least one opening in the fan shroud, wherein the at least one heat exchanger, the fan shroud and the fan are arranged in the inclined position with respect to the ground.

BRIEF DESCRIPTION OF THE DRAWINGS

The present invention will be described in greater detail below with reference to the drawings. In the drawings:

FIG. 4 shows the fan shroud according to the invention in a perspective view, with an enlarged partial view;

DETAILED DESCRIPTION OF THE INVENTION

Figure 1:
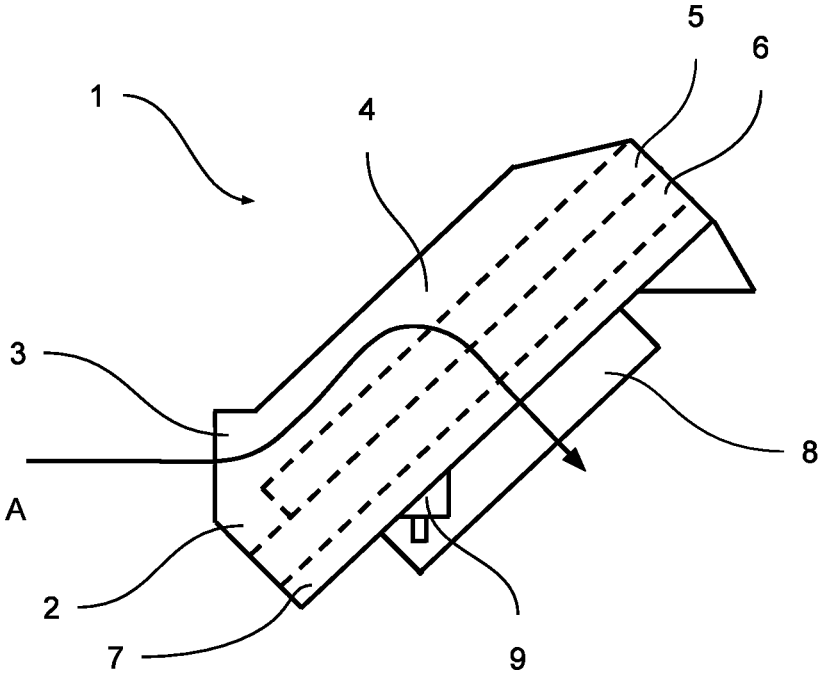
FIG. 1 shows a schematic view of a heat-exchange module according to the invention from a side.

FIG. 1 shows a schematic view of a heat-exchange module according to the invention from a side.

The heat-exchange module 1 includes a conduit 2 encapsulating at least one heat exchanger. In the shown embodiment, the heat-exchange module 1 includes a first heat exchanger 5 and a second heat exchanger 6. In general, the invention is applicable to various architectures of heat-exchange modules with a different number of heat exchangers, for example those including only the first heat exchanger 5, or those including more than the first and second heat exchanger 5, 6, depending on the cooling or heating needs of the heat-exchange module and the vehicle in which it is installed. The description below will focus on an embodiment with the first and second heat exchangers 5, 6, i.e. with two heat exchangers.

The conduit 2 includes an air inlet 3. The air entering the air inlet 3 is guided through an air guide 4 to and through the first and second heat exchangers 5, 6.

The heat-exchange module 1 includes a fan shroud 7 to which a fan 8 is attached. The fan shroud 7 with the fan 8 are located downstream of the first and second heat exchangers 5, 6. The fan shroud 7 has a wall 11 configured to at least partially block the airflow through the fan shroud 7 between a front and a back thereof, while having a first opening 12 for enabling the airflow. The fan shroud 7 further includes fasteners 9 adapted to mount the fan shroud 7 in an inclined position with respect to the ground. Such mounting of the fan shroud 7, and consequently of the fan 8, is required in cases when the first and second heat exchangers 5, 6 are also mounted in inclined positons, as is the case in shown embodiment. Inclined positions of the heat exchangers 5, 6 can be required in view of packaging constrains within the vehicles body. Preferably, the conduit 2 is sealed with respect to the outer environment between the air inlet 3 and the fan shroud 7.

The first heat exchanger 5 can be a condenser, and the second heat exchanger 6 can be a radiator. The first heat exchanger 5 and the second heat exchanger 6 are arranged one after the other according to the direction of travel of the vehicle.

The heat-exchange module 1 is intended to be mounted behind a front grille panel of a motor vehicle. In operation, for example when the vehicle is moving forwards, air A passes through the grille and enters the air inlet 3 and travels through the air guide 4 before arriving to the first and second heat exchanger 5, 6 in order to pass through them. Subsequently, the air traverses the fan shroud 7 through the first opening 12 and leaves the heat-exchange module 1.

The first and second heat exchangers 5, 6, which are mounted one behind the other in the direction of travel of the vehicle, are supported within the same conduit 2, which surrounds and encloses them. The conduit 2 in this case constitutes an airtight envelope, which channels the air in order to ensure that the flow of air passing through the first exchanger 5 also passes through the second heat exchanger 6.

In order to create a sufficient flow of air A when the speed of the vehicle is too low, the heat-exchange module 1 is equipped on its rear side with the fan 8. Said fan 8 is thus situated opposite the second heat exchanger 6, and is attached to the fan shroud 5, which either extends the conduit 2 or is located inside of it. Thanks to such arrangement, almost all of the air displaced by the fan 8 is passed through the first and second heat exchangers 5, 6.

Figure 2:
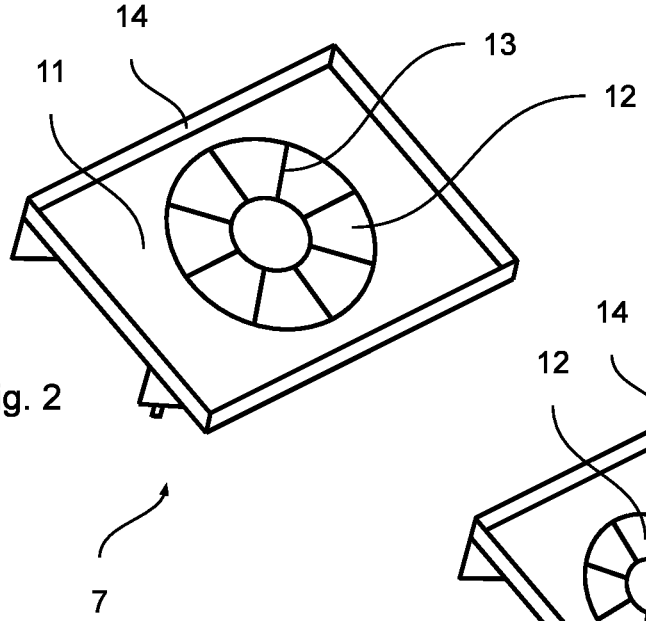
FIG. 2 shows a first example of a fan shroud according to the invention.

FIG. 2 shows a first example of the fan shroud 7 according to the invention. In the shown embodiment, the fan shroud 7 has a rectangular outline, matching the general outline of heat exchangers 5, 6 located upstream. The wall 11 can occupy the whole or most of the inner space defined by the fan shroud 7 or a smaller portion of it. The wall 11 is configured to at least partially block the airflow through the fan shroud 7. Preferably, the wall 11 is arranged to completely block the airflow through the fan shroud 7.

The fan shroud 7 can include one or more sidewalls 14 located at the edges of the wall 11, which can facilitate mounting of the fan shroud 7 to other components. The sidewalls 14 can also have an air sealing function and can enhance the rigidity of the fan shroud 7. The sidewalls 14 can extend along the air A flow path, i.e. substantially perpendicular to the surface of the wall 11. The fan shroud 7 includes the first opening 12 for enabling airflow between the front and the back thereof. The fan shroud 7 can include attachment arms 13 for attaching the fan 8 to the fan shroud 7, in particular to the wall 11.

Figure 3:
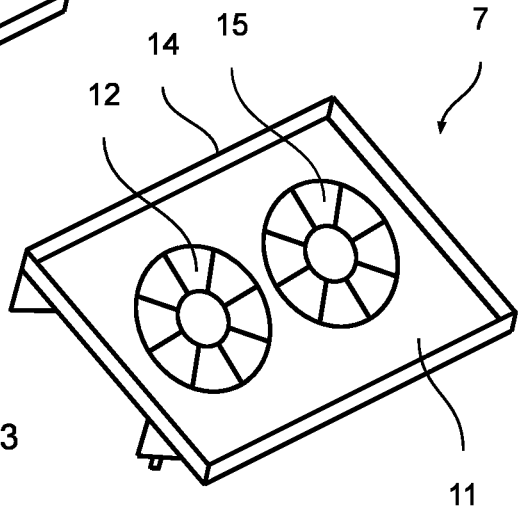
FIG. 3 shows a second example of a fan shroud according to the invention.

FIG. 3 shows a second example of a fan shroud 7 according to the invention. Compared to example shown in FIG. 2, the fan shroud 7 has a second opening 15 for the air, with the same function as the first opening 12. This example covers a situation in which more than one fan 8 is required within the heat-exchange module 1, for example to achieve a more desirable air-flow path or heat exchange efficiency.

Preferably, in such case, both fans 8 and the first and second openings 12, 15 are respectively identical.

FIG. 4 shows the fan shroud 5 according to the invention in a perspective view, with an enlarged partial view. In general, moisture, water or any other foreign material, collectively referenced to as fluid, can enter the heat-exchange module through the front grill (not shown) and the air inlet 3. It may end on the fan shroud 7 or fan blades of the fan 8, where it can stay or from where it can travel downwards. Since the heat-exchange module 1 is desired to not allow air to escape between the air inlet 3 and the fan 8, the same applies to the fluid. In winter conditions, the fluid may freeze, risking damage to the heat-exchange module 1 and its components. When the assembly of any heat exchangers 5, 6 and the fan shroud 7 with the fan 8 are mounted at an inclined position with respect to the ground, the fluid can collect in undesired location. It can be difficult to control, in particular when the fan shroud 7 is the last component on the air-flow path. For this reason, the fan shroud 7 includes a first drainage opening 20 for the fluid. The first drainage fluid opening 20 allows the fluid collected in the heat-exchange module 1 to be evacuated to the outside, and mitigate the risk of any damage. Preferably, the first drainage opening 20 is located closer to one of the sides of the fan shroud 7. Preferably, the first drainage opening 20 is located at a bottom corner of the fan shroud 7.

The wall 11 of the fan shroud 7 includes a first wall part 18. The first wall part 18 can be located below the first opening 12. Below the first wall part 18, there is located a first slope 16. In other words, the first wall part 18 terminates at the first slope 16. The first slope 16 is a stepped element, which is inclined toward the bottom portion of the fan shroud 7, so that any fluid reaching the first slope 16 and subject to gravitational force is directed along it in a downward direction. In this case, the first slope 16 runs along the bottom portion of the fan shroud 7 towards one of its sides, towards the first drainage opening 20.

The first slope 16 has its lowest point at the level the first drainage opening 20 when the fan shroud 7 is in the inclined position. Thus, the fluid reaching the wall 11 will travel along the first wall part 18 to the first slope 16, and along it to the first drainage opening 20.

FIG. 4 shows an embodiment with a second slope 17, which will be discussed in detail below in relation to FIG. 5*a*.

Figure 5A:
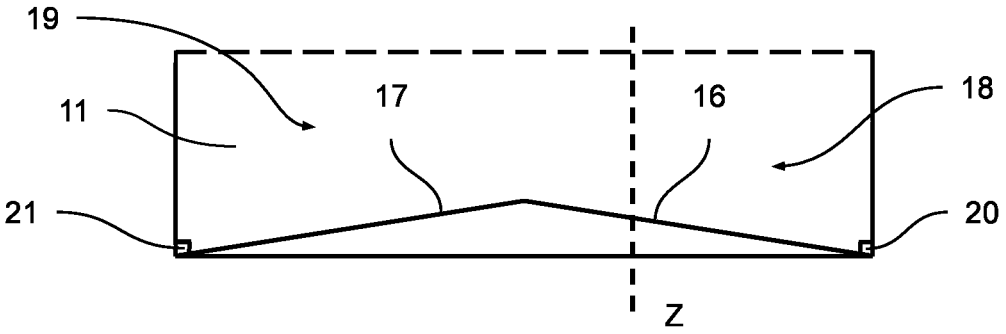
FIG. 5*a* shows a schematic front view of an example of the bottom portion of the fan shroud.

As shown schematically in FIG. 5*a*, the fan shroud 7 can include a second drainage opening 21 for a fluid, with the same purpose as the first drainage opening 20. In general, the wall 11 of the fan shroud 7 can include a second wall part 19. Below the second wall part 19 there is located a second slope 16. In other words, the second wall part 19 terminates at the second slope 16. The second slope 16 is a stepped element, which is inclined toward the bottom portion of the fan shroud 7, so that any fluid reaching the second slope 16 and subject to gravitational force is directed along it in a downward direction. In this case, the second slope 16 runs along the bottom portion of the fan shroud 7 towards one of its sides, towards the second drainage opening 20.

The second slope 16 can slope in a direction opposite than the first slope 15. The can have equal or unequal lengths.

In case there are two openings, i.e. the first opening 12 and the second opening 15, to let the air through the fan shroud 7, the first opening 12 can be arranged over the first slope 16 and the second opening 15 can be arranged above the second slope 17. In such case there are also two fans 8 associated with each opening 12, 15. In case of a single first opening 12, the first wall part 18 and the second wall part 19, as well as the first slope 16 and the second slope 17 can be both located below it, next to each other.

As shown in FIG. 5*a*, the first slope 16 and the second slope 17 can have a common highest point. The first slope 16 and the second slope 17 can be also arranged symmetrically with respect to the central portion or axis of the fan shroud 7.

Figure 5B:
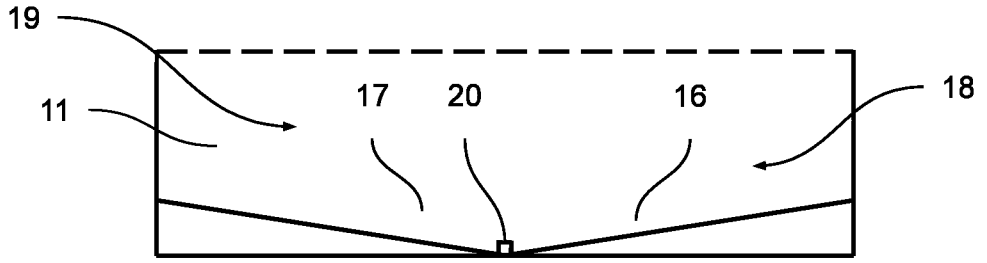
FIG. 5*b* shows a schematic front view of another example of the bottom portion of the fan shroud.

FIG. 5*b* shows a schematic front view of another example of the bottom portion of the fan shroud 7. Here, the first slope 16 and the second slope 17 have a common lowest point, where a first drainage opening 20 is located.

Figure 6:
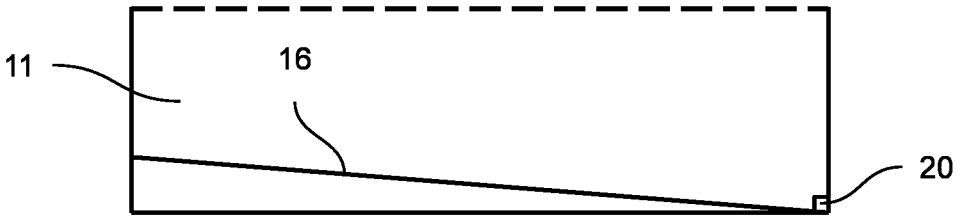
FIG. 6 shows a schematic front view of another example of the bottom portion of the fan shroud.

FIG. 6 shows a schematic front view of another example of the bottom portion of the fan shroud 7. In this example, there is only one slope, namely the first slope 16, extending from one side of the fan shroud 7 to the other. The first slope 16 terminates at the level of the first drainage opening 20. In this example, there may be only the first opening 12 arranged above the single first slope 16 or the first opening 12 with the second opening 15 next to it, both being arranged above the single first slope 16. The first slope 16 in this case extends from one side to the other, the highest point being adjacent to one side, and the first drainage opening 20 being adjacent to the other side.

It is to be noted that there can be a plurality of first drainage openings 20, and optionally a plurality of second drainage openings 21, depending on specific applications. The shape of the drainage openings can take various forms, e.g. square, rectangular, slit-like, circular, oval etc.

Figure 7:
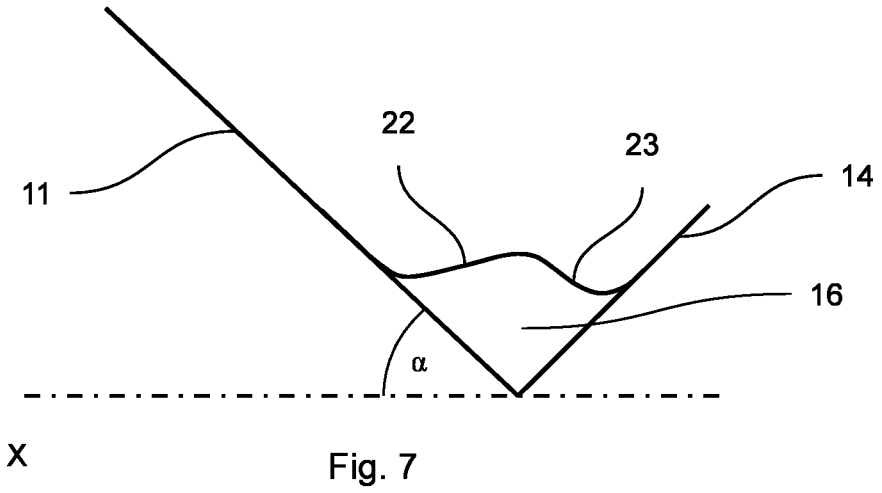
FIG. 7 shows a schematic cross section of the bottom portion of the fan shroud.

FIG. 7 shows a schematic cross section of the bottom portion of the fan shroud 7 of FIG. 5*a* taken along plane Z. The wall 11 of the fan shroud 7 is inclined at the angle A with respect to the ground, the ground being a horizontal plane of reference X. Because the wall 11 of the fan shroud 7 is inclined, any fluid will travel along it in a downward direction to reach the first slope 16, and then will travel along the first slope 16 towards a corresponding first drainage opening 20 so that it can be evacuated outside of the fan shroud 7. The angle A is preferably comprised within the range of 20 degrees-75 degrees.

The first slope 16 may have a primary first slope portion 22 and a secondary first slope portion 23. The primary first slope portion 22 is arranged closer to the wall 11, while the secondary first slope portion 23 is arranged closer to the bottom, preferably to the bottom sidewall 14. The primary first slope portion 22 generally slopes in a direction opposite to the sloping direction of the secondary first slope portion 23 when viewed along the airflow general direction, i.e. viewed perpendicular to the wall 11. Since the primary first slope portion 22 and the secondary first slope portion 23 have common highest points, i.e. a ridge extending along the bottom of the fan shroud 7, they create two parallel depressions for the fluid. The fluid can thus be led to the corresponding drainage opening 20, 21 with risk of accumulating along its way being mitigated.

The embodiments of the first slope 16 described with relation to FIG. 7 can be reflected also in the structure of the second slope 17, with corresponding primary second slope and secondary second slope being arranged analogously.

Figure 8:
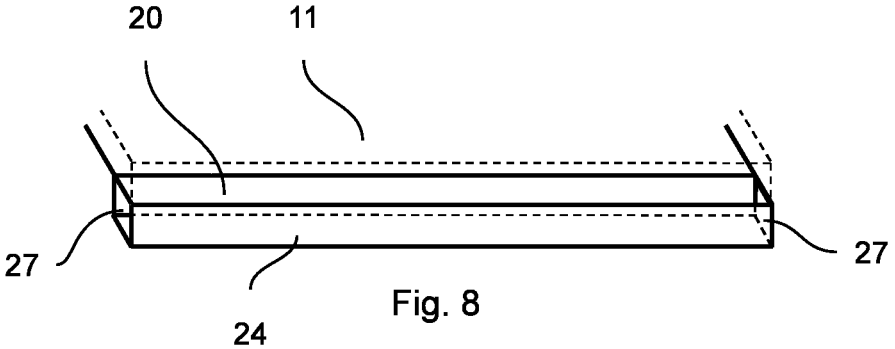
FIG. 8 shows a schematic partial perspective view of the bottom portion of the fan shroud with a single drainage opening and a single gutter.

FIG. 8 shows a schematic perspective view of the bottom portion of the fan shroud 7 with a single first drainage opening 20 and a single first gutter 24. The first drainage opening 20 extends along the bottom of the fan shroud 7, in particular along the bottom portion of the wall 11. The first gutter 24 extends along the first drainage opening 20, preferably along the whole length of the first drainage opening 20. The first gutter 24 receives fluid from the first drainage opening 20 and leads it towards a gutter opening 27 located remotely with respect to the first drainage opening 20. The first gutter 24 in this embodiment has two gutter openings 27 located at its opposite ends. The gutter openings 27 can be at the level of, i.e. coincide with, the side sidewalls 14 of the fan shroud 7.

The first gutter 24 is preferably designed in a way to ensure no additional turbulence is created, which could increase the audible noise. The first gutter 24 can be integral with the fan shroud 7, or can be a separate attachment.

Figure 9:
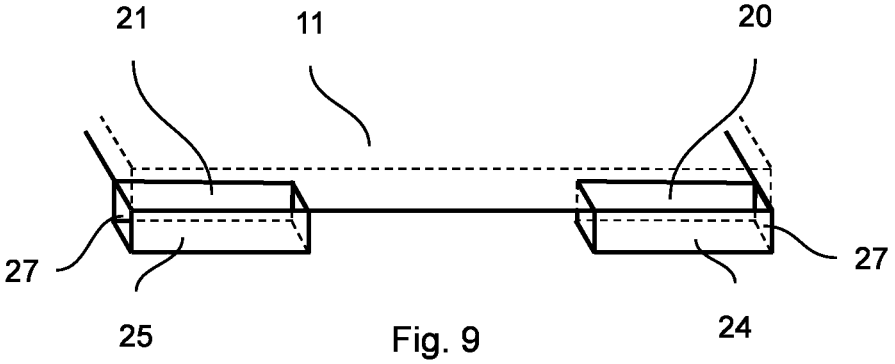
FIG. 9 shows a schematic partial perspective view of the bottom portion of the fan shroud with two drainage openings and two gutters.

FIG. 9 shows a schematic perspective view of the bottom portion of the fan shroud 7 with a first drainage opening 20, a second drainage opening 21, a first gutter 24 and a second gutter 25.

The first drainage opening 20 is associated with the first gutter 24, while the second drainage opening 21 is associated with the second gutter 25. In other words, the fluid reaches the first gutter 24 through the first drainage opening 20, and the second gutter 25 through the second drainage opening 25, and then exits through respective gutter openings 27.

Figure 10:
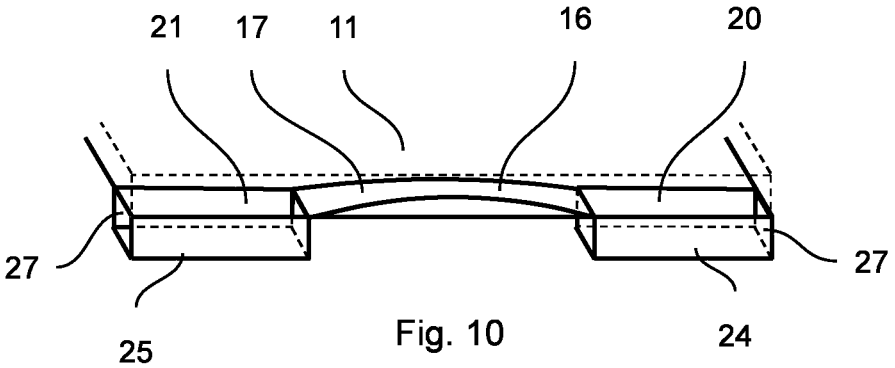
FIG. 10 shows a variant of the example of FIG. 9 with slopes.

FIG. 10 shows a variant of the example of FIG. 9 with a first slope 16 and a second slope 17. The first slope 16 leads the fluid towards the first drainage opening 20, while the second slope 17 leads the fluid towards the second drainage opening 21.

Figure 11:
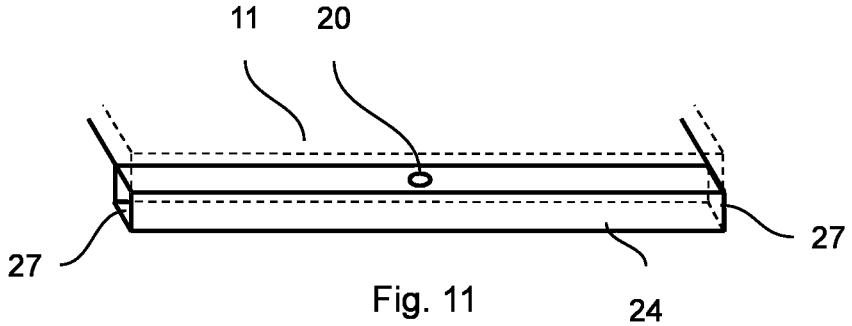
FIG. 11 shows a schematic partial perspective view of the bottom portion of another example of the fan shroud with a single drainage opening and a single gutter.

FIG. 11 shows a schematic perspective view of the bottom portion of another example of the fan shroud 7 with a single first drainage opening 20 and a single first gutter 24. The first drainage opening 20 in this embodiment is a circular hole, located in a central position of the bottom portion of the fan shroud 7. The first gutter 24 extends along the whole length of the bottom of the fan shroud 7. It can also extends only along a portion thereof.

Figure 12:
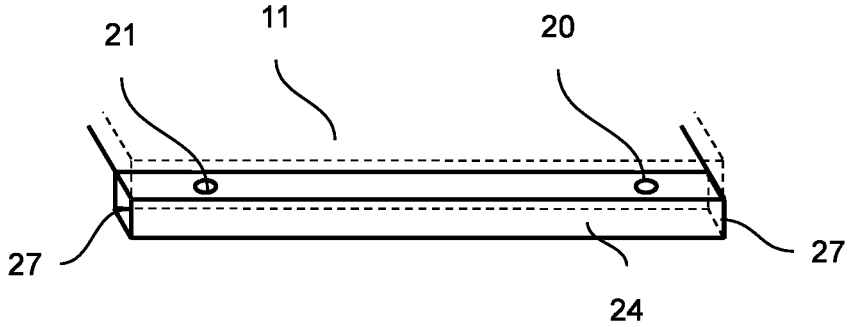
FIG. 12 shows a schematic partial perspective view of the bottom portion of the fan shroud with two drainage openings and one gutter.

FIG. 12 shows a schematic perspective view of the bottom portion of the fan shroud 7 with a first drainage opening 20, a second drainage opening 21, and a first gutter 24. The first drainage opening 20 and the second drainage opening 21 are in these embodiments circular holes. The first drainage opening 20 is located closer to a first side sidewall 14 of the fan shroud 7, while the second drainage opening 21 is located closer to a second side sidewall 14 of the fan shroud 7.

Figure 13:
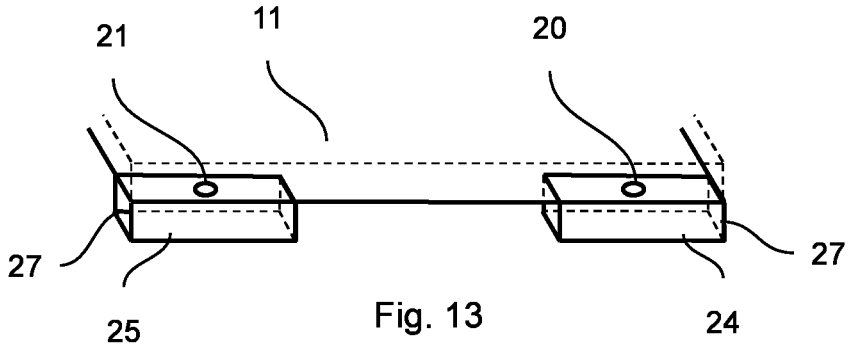
FIG. 13 shows a schematic partial perspective view of the bottom portion of another example of the fan shroud with two drainage openings and two gutters.

FIG. 13 shows a schematic perspective view of the bottom portion of another example of the fan shroud 7 with a first drainage opening 20, a second drainage opening 21, a first gutter 24 and a second gutter 25. The first drainage opening 20 is associated with the first gutter 24, while the second drainage opening 21 is associated with the second gutter 25. The first drainage opening 20 and the second drainage opening 21 are in these embodiments circular holes.

Figure 14:
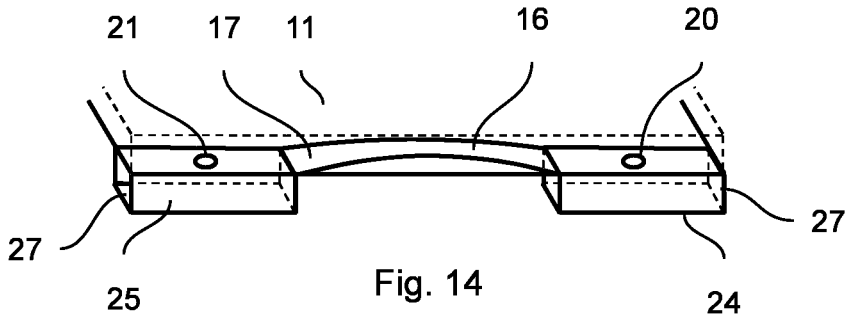
FIG. 14 shows a variant of the example of FIG. 13 with slopes.

FIG. 14 shows a variant of the example of FIG. 13 with a first slope 16 and a second slope 17. The first slope 16 leads the fluid towards the first drainage opening 20, while the second slope 17 leads the fluid towards the second gutter opening 21. The first drainage opening 20 and the second drainage opening 21 are in these embodiments circular holes.

In any case, the first drainage opening 20 and the second drainage opening 21 can be also added on the bottom side of any first or second gutter 24, 25.

Figure 15:
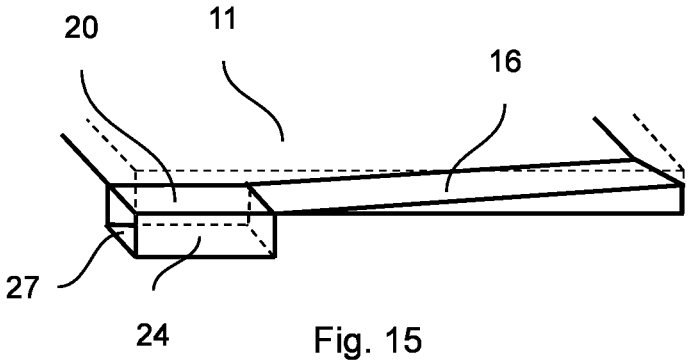
FIG. 15 shows a schematic view of the bottom portion of another example of the fan shroud with a drainage opening and a gutter with a slope.

FIG. 15 shows a schematic view of the bottom portion of another example of the fan shroud 7 with a first drainage opening 20 and a first gutter 24 with a first slope 16. The first slope 16 in this embodiment extends along almost whole length of the bottom portion of the fan shroud 7, thereby collecting any fluid present on the wall 11 and leading it towards the first drainage opening 20. Subsequently, the fluid travels through the first gutter 24 to the gutter opening 27 and leaves the fan shroud 7 in a controlled manner.

Figure 16:
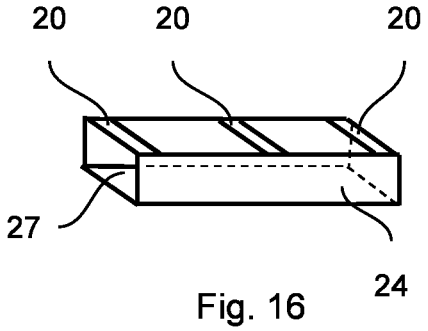
FIG. 16 shows another example of openings configuration with the gutter.

FIG. 16 shows another example of the drainage openings configuration. In the shown embodiment, there is a plurality of first drainage openings 20 in form of slits. Alternatively, there may be a single first drainage opening 20 in form of a slit. By means of a slit, it is meant a generally narrow, rectangular opening. The orientation of the slit, i.e. its direction of extension, can be parallel, perpendicular or oblique with respect to extension axis of any associated gutter 24, 25, depending on specific needs. Features discussed with respect to first drainage openings 20 here apply to any second drainage opening 21 mutatis mutandis.

Figure 17A:
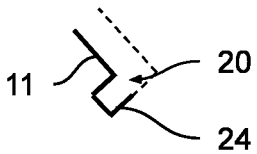
FIG. 17*a* shows an example of a gutter protruding perpendicularly from the wall of the fan shroud.

FIG. 17*a* shows an example of a first gutter 24 protruding perpendicularly to the wall 11 of the fan shroud 7. The first gutter 24 protrudes from the fan shroud 7, i.e. from the wall 11, substantially perpendicularly to a plane in which the wall 7 extends.

Figure 17B:
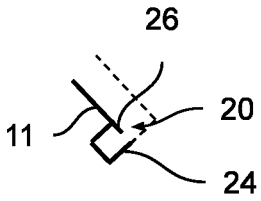
FIG. 17*b* shows another example of a gutter protruding perpendicularly from the wall of the fan shroud.

FIG. 17*b* shows another example of a first gutter 24 protruding perpendicularly to the wall 11 of the fan shroud 7. The first gutter 24 protrudes from the fan shroud 7, i.e. from the wall 11, substantially perpendicularly to a plane in which the wall 7 extends. The first gutter 24 includes a lip 26 covering a portion of the first drainage opening 20. The lip 26 extends from the wall 11, preferably within the same plane. The lip 26, or any such extension, has at least three advantages. Firstly, it reduces the open area to gutter and likely reduces turbulence, which then could reduce noise. The lip 26, whether straight or angled, also provides a surface tension effect to collect the water into larger droplets and allow them to drop into the first gutter 24. The angled upward option for lip 26 can also divert some airflow away from first gutter 24 and the first drainage opening 20, thus potentially reducing audible noise.

Figure 17C:
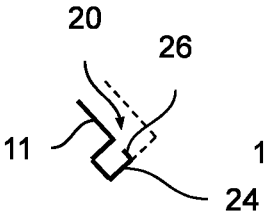
FIG. 17*c* shows another example of a gutter protruding perpendicularly from the wall of the fan shroud.

FIG. 17*c* shows another example of a first gutter 24 protruding perpendicularly to the wall 11 of the fan shroud 7. The first gutter 24 protrudes from the fan shroud 7, i.e. from the wall 11, substantially perpendicularly to a plane in which the wall 7 extends. The first gutter 24 includes a lip 26 covering a portion of the first drainage opening 20. The lip 26 extends from the first gutter 24, remotely with respect to the wall 11, preferably within the same plane that the wall 11.

Figure 17D:
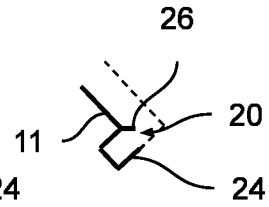
FIG. 17*d* shows another example of a gutter protruding perpendicularly from the wall of the fan shroud.

FIG. 17*d* shows another example of a first gutter 24 protruding perpendicularly to the wall 11 of the fan shroud 7. The first gutter 24 protrudes from the fan shroud 7, i.e. from the wall 11, substantially perpendicularly to a plane in which the wall 7 extends. The first gutter 24 includes a lip 26 covering a portion of the first drainage opening 20. The lip 26 extends from the first gutter 24, remotely with respect to the wall 11, preferably at an angle with respect to the plane of the wall 11, in order to reduce noise.

Figure 18A:
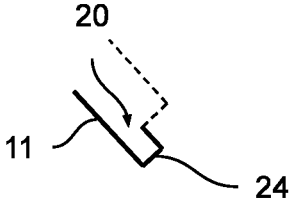
FIG. 18*a* shows an example of a gutter protruding in parallel to the wall of the fan shroud.

FIG. 18*a* shows an example of a first gutter 24 protruding in parallel to the wall 11 of the fan shroud 7. The first gutter 24 protrudes from the fan shroud 7, i.e. from the wall 11, substantially in parallel to a plane in which the wall 7 extends.

Figure 18B:
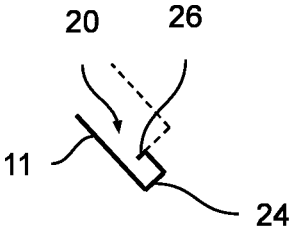
FIG. 18*b* shows another example of a gutter protruding in parallel to the wall of the fan shroud.

FIG. 18*b* shows another example of a first gutter 24 protruding in parallel to the wall 11 of the fan shroud 7. The first gutter 24 protrudes from the fan shroud 7, i.e. from the wall 11, substantially in parallel to a plane in which the wall 7 extends. The first gutter 24 includes a lip 26 covering a portion of the first drainage opening 20. The lip 26 extends from the first gutter 24, remotely with respect to the wall 11.

Figure 18C:
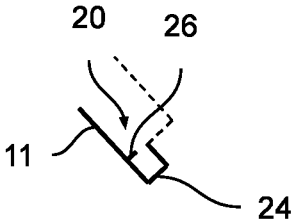
FIG. 18*c* shows yet another example of a gutter protruding in parallel to the wall of the fan shroud.

FIG. 18*c* shows another example of a first gutter 24 protruding in parallel to the wall 11 of the fan shroud 7. The first gutter 24 protrudes from the fan shroud 7, i.e. from the wall 11, substantially in parallel to a plane in which the wall 7 extends. The first gutter 24 includes a lip 26 covering a portion of the first drainage opening 20. The lip 26 extends from the wall 11.

Other variations to the disclosed embodiments can be understood and effected by those skilled in the art in practicing the claimed invention, from a study of drawings, the disclosure, and the appended claims. The mere fact that certain measures are recited in mutually different dependent claims does not indicate that a combination of these measures cannot be used to the advantage.

Other variations to the disclosed embodiments can be understood and effected by those skilled in the art in practicing the claimed invention, from a study of drawings, the disclosure, and the appended claims. The mere fact that certain measures are recited in mutually different dependent claims does not indicate that a combination of these measures cannot be used to the advantage.

The invention claimed is:

1. A fan shroud for a vehicle heat-exchange module, comprising:

a wall configured to at least partially block the airflow through the fan shroud between a front and a back thereof, with a first opening for enabling airflow through the fan shroud between a front and a back thereof, fasteners adapted to mount the fan shroud in an inclined position with respect to the ground, a first drainage opening for a fluid, arranged at a bottom of the fan shroud and a first slope with a lowest point being at the level of the first drainage opening when the fan shroud is in the inclined position.

2. The fan shroud according to claim 1, wherein a first wall part of the wall terminates at the first slope.

3. The fan shroud according to claim 1, wherein the wall includes a second opening for enabling airflow through the fan shroud between the front and the back thereof.

4. The fan shroud according to claim 1, including a second slope sloping in a direction opposite than the sloping direction of the first slope.

5. The fan shroud according to claim 1, including a second slope sloping in a direction opposite than the sloping direction of the first slope, wherein the wall includes a second opening for enabling airflow through the fan shroud between the front and the back thereof, the first opening being arranged over the first slope and the second opening being arranged above the second slope.

6. The fan shroud according to claim 1, including a second slope sloping in a direction opposite than the sloping direction of the first slope, wherein the wall includes a second opening for enabling airflow through the fan shroud between the front and the back thereof, both the first opening and the second opening being arranged over the first slope.

7. The fan shroud according to claim 4, wherein the lowest point of the second slope terminates in a second drainage opening.

8. The fan shroud according to claim 4, wherein a second wall part of the wall terminates at the second slope.

9. The fan shroud according to claim 4, wherein the first slope and the second slope have a common highest point.

10. The fan shroud according to claim 4, wherein the first slope and the second slope have a common lowest point.

11. The fan shroud according to claim 4, wherein the first slope and the second slope are arranged symmetrically with respect to the central portion of the fan shroud.

12. The fan shroud according to claim 1, including a first gutter arranged at the bottom and connected fluidically with the first drainage opening to evacuate the fluid remotely with respect to the first drainage opening.

13. The fan shroud according to claim 1, having a rectangular outline.

14. The fan shroud according to claim 13, wherein the first drainage opening is located at a bottom corner of the fan shroud.

15. The fan shroud according to claim 1, having a rectangular outline, the first drainage opening being located at a bottom corner of the fan shroud, and the lowest point of the second slope terminating in a second drainage opening, wherein the second drainage opening is located at the opposite bottom corner of the fan shroud.

16. A heat-exchange module including at least one heat exchanger, a fan shroud for a vehicle heat-exchange module, comprising:

a wall configured to at least partially block the airflow through the fan shroud between a front and a back thereof, with a first opening for enabling airflow through the fan shroud between a front and a back thereof, fasteners adapted to mount the fan shroud in an inclined position with respect to the ground, a first drainage opening for a fluid, arranged at a bottom of the fan shroud and a first slope with a lowest point being at the level of the first drainage opening when the fan shroud is in the inclined position;

a fan attached to the fan shroud, a conduit encapsulating the at least one heat exchanger and including an air inlet, so that the air entering the air inlet is guided through the at least one heat exchanger and the at least one opening in the fan shroud, wherein the at least one heat exchanger, the fan shroud and the fan are arranged in the inclined position with respect to the ground.

* * * * *